United States Patent [19]

Miyazaki et al.

[11] 4,105,165

[45] Aug. 8, 1978

[54] ARRANGEMENT FOR PROVIDING TRANSFER TAIL WINDINGS ON A BOBBIN

[75] Inventors: Tsutomu Miyazaki, Kariya; Toshio Yoshizawa, Chiryu; Yoshiaki Yoshida, Ohbu; Kinpei Mitsuya, Aichi; Takeshi Ogasawara, Gamagori, all of Japan

[73] Assignee: Kabushiki Kaisha Toyoda Jidoshokki Seisakusho, Kariya, Japan

[21] Appl. No.: 788,966

[22] Filed: Apr. 19, 1977

[30] Foreign Application Priority Data

Apr. 27, 1976 [JP] Japan ..... 51-48321

[51] Int. Cl.[2] ..... B65H 54/02

[52] U.S. Cl. ..... 242/18 PW; 242/19

[58] Field of Search ..... 242/18 PW, 19; 57/34 PW, 34 TT

[56] References Cited

U.S. PATENT DOCUMENTS

| | | | |
|---|---|---|---|
| 3,065,921 | 11/1962 | Furst | 242/18 PW |
| 3,097,804 | 7/1963 | Jackson | 242/18 PW |
| 3,224,692 | 12/1965 | Nugent | 242/18 PW |
| 3,948,452 | 4/1976 | Burysek et al. | 242/18 PW |
| 4,002,305 | 1/1977 | Takeuchi et al. | 242/18 PW |

FOREIGN PATENT DOCUMENTS

| | | | |
|---|---|---|---|
| 1,510,997 | 1/1970 | Fed. Rep. of Germany | 242/18 PW |
| 2,431,145 | 3/1975 | Fed. Rep. of Germany | 242/18 PW |
| 1,589,073 | 4/1970 | Italy | 242/18 PW |

*Primary Examiner*—Stanley N. Gilreath

[57] ABSTRACT

A yarn handling machine includes bobbins on which yarns are wound, forming cheeses. At the beginning of the yarn winding operation, transfer tail windings must be provided on the end of the bobbin.

An arrangement for providing transfer tail windings includes a yarn guide movable between an operative position closely adjacent to the bobbin and an inoperative position spaced from the bobbin sufficient to prevent interference of the yarn guide with the formation of the cheese. In the operative position, the yarn guide serves for providing the transfer tail windings.

5 Claims, 8 Drawing Figures

ARRANGEMENT FOR PROVIDING TRANSFER TAIL WINDINGS ON A BOBBIN

BACKGROUND OF THE INVENTION

The field of art to which our invention relates includes yarn handling machines, and more specifically yarn guides utilized in the yarn handling machine to form transfer tail windings on a bobbin.

A principal object of our invention is to provide an improved yarn guide which eliminates disadvantages of the prior art.

Another object of our invention is to provide an improved yarn guide which is simple, low cost and provides for the forming of good transfer tail windings in the associated yarn handling machine.

SUMMARY OF THE INVENTION

In carrying out our invention in preferred embodiments, we provide a yarn guide for use with a yarn handling machine having a bobbin on which the yarn is to be wound. The yarn guide is adapted to be movable between an operative position adjacent the end of the bobbin, on which the transfer tail windings are formed, and a retracted position away from the bobbin. In the preferred embodiment, the movement of the yarn guide toward its operative position is carried out in cooperation with a cutter.

The above and other objects, features and advantages of our invention will be more readily understood from the following detailed description taken in conjunction with the accompanying drawings.

DESCRIPTION OF THE PREFERRED EMBODIMENTS

Figure 1:
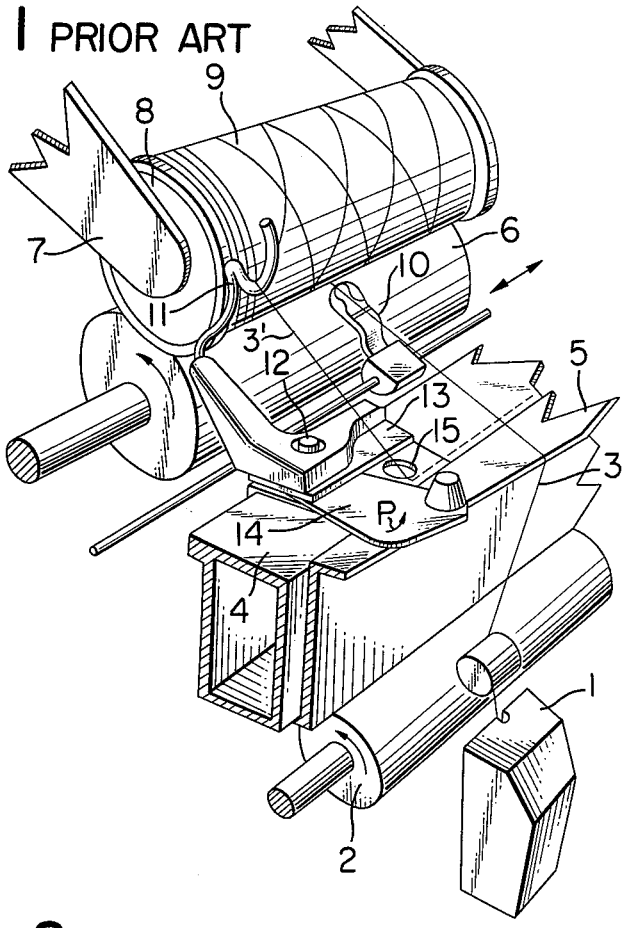
FIG. 1 PRIOR ART
FIG. 1 is a fragmental perspective view showing, partly in section, a prior art arrangement for providing transfer tail windings.

Referring now to the drawings, wherein the similar reference numerals designate the same or corresponding components throughout various figures, and more particularly to FIG. 1 there is shown a prior art arrangement for providing transfer tail windings.

Generally, in a yarn handling machine including a winder mechanism by which yarn is wound onto a bobbin to form a cheese, at the beginning of the winding operation, so-called transfer tail windings must be formed on the end of the bobbin so that the resultant cheese can be used in the next yarn processing operation by connecting the end of the transfer tail winding of the resultant cheese, subsequent to the rewinding of the resultant cheese, with the yarn end of another cheese. For this purpose, the winder mechanism includes an arrangement for providing the transfer tail windings.

In the normal operation of the prior art arrangement shown in FIG. 1, which is used with an open end spinning machine, a yarn 3 spun in a spinning chamber of a spinning unit 1 is drawn out therefrom by a pair of taking-out rollers 2 and passes over a side edge of a guide plate 5 securely connected to a portion of the spinning machine. The yarn 3 is then guided into an open loop of a traversing device 10, traversed by a known driving means (not shown), from which it is taken-up onto a bobbin 9 disposed on a drive roll 6 in frictional engagement therewith.

In operation, for providing the transfer tail windings, first the yarn 3 drawn by the taking-out rollers 2 from the spinning chamber is adapted to be directly sucked into an associated opening 15 provided in the top of a suction duct 4 extending longitudinally along the spinning machine. Then, an empty bobbin 9 which is not held by a cradle 7 yet is placed below the yarn portion between the opening 15 and the taking-out rollers 2 and thereafter moved with the yarn to the position of the cradle 7 to be held thereby. The cradle 7 is lowered to bring the bobbin 9 into contact with the drive roller 6, whereupon the yarn 3 continuously coming out from the spinning chamber is caused to pass through the traversing device 10, around the bobbin 9 and to the opening 15 in the suction duct 4, which is connected to a not shown suitable source of suction, such as a blower, to suck the yarn thereinto successively in cooperation with the rotation of the bobbin 9. At this time, the winding of the yarn onto the bobbin 9 has not commenced yet. When the traversing device 10 along with the yarn reaches adjacent the left hand traverse limit, the yarn portion extending around the bobbin 9 into the opening 15 is brought by the operator's one hand into engagement with a hooked yarn guide 11, while substantially at the same time the yarn portion 3 adjacent the opening 15 is held against movement by operator's other hand to prevent it from being sucked into the suction duct 4. This causes slack in the yarn 3' between the bobbin 9 and the opening 15, the slack yarn being rotated with the bobbin 9 and brought into the nip formed between the bobbin 9 and the drive roller 6. It is therefore understood that the bobbin 9 is allowed to begin the normal winding of the yarn being traversed by the traversing device 10 and at the same time to pull back the yarn 3', which has been received within the suction duct 4, against the suction force. The pulled back yarn passes through the yarn guide 11 onto the circumferential end surface of the bobbin, thus beginning the formation of the transfer tail windings. When the desired transfer tail windings are attained, a movable cutting member 14 is moved in the direction indicated by the arrow P toward a stationary cutting member 13 to cut the yarn 3'. On the one hand the resultant yarn end **3*a* (FIG. 2) is wound up onto the bobbin end, on the other hand the yarn 3 from the spinning chamber is traversely wound on the bobbin. The yarn guide 11 is fixed in the position as shown by a setting screw 12 and the cradle 7 has a disk 8 to center the bobbin 9**.

Figure 2:
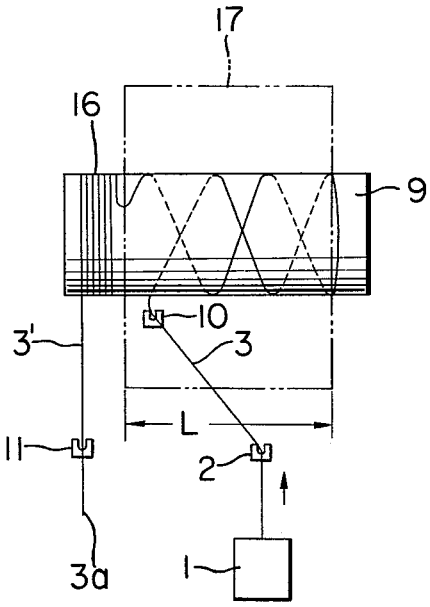
FIG. 2 PRIOR ART
FIG. 2 is an elevational view of the prior art arrangement shown in FIG. 1, illustrating the location of the transfer tail windings.
Figure 3:
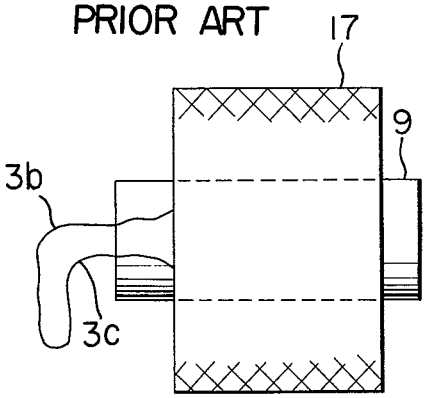
FIG. 3 PRIOR ART
FIG. 3 shows a cheese produced by the associated yarn handling machine employing the prior art arrangement shown in FIG. 1.

As clearly shown in FIG. 2, the transfer tail windings 16 are provided at a position adjacent the end of the bobbin, i.e., a position outside of the dimension L of the traverse of the traversing device 10. Such a position of the transfer tail windings depends on the position of the yarn guide 11. When the pulled back yarn 3' is cut by the cutter comprising the movable and stationary cutting members 14 and 13 and the resultant yarn end 3a is pulled back beyond the yarn guide 11, it often occurs that the yarn end 3a runs laterally into the range L of traverse necessitated by the formation of the cheese, whereby the yarn end 3a is pinned under the succeeding yarn 3 traversely wound on the bobbin. Because of this, even after the transfer tail windings 16 are undone, the yarn end portion forms a closed loop comprising yarn portions 3b and 3c as shown in FIG. 3. It can not be determined which portion 3b or 3c extends to the yarn end 3a. Such an undesirable occurrence must be eliminated.

This disadvantage of the prior arrangement can be eliminated by employing an improved arrangement constructed according to the teachings of our invention and illustrated in the subsequent figures.

Figure 4:
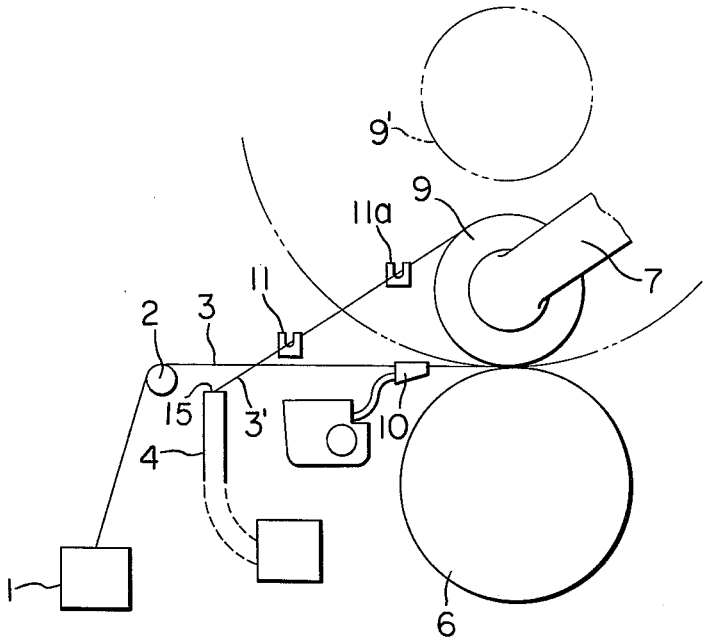
FIGS. 4 and 5 are diagrammatic views for facilitating comparison of the transfer tail winding operation of the present invention and that of the prior art.
Figure 5:
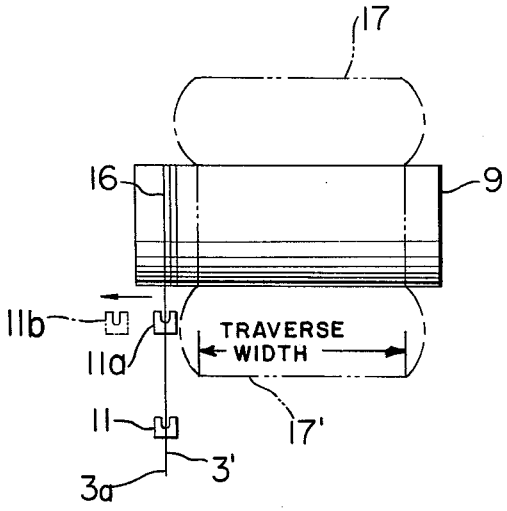

In FIGS. 4 and 5, the yarn guide 11 of the prior art arrangement is always disposed at a fixed position spaced sufficiently away from the bobbin 9 not to interfere with the maximum diameter 17' of the cheese 17. In general, a cheese has a characteristic that its opposed ends become expanded axially outwardly relative to the traverse width as its diameter increases, and the bobbin has a limited length, necessitating that the transfer tail windings be formed very near the traverse range. These conditions make it undesirable to locate the stationary yarn guide 11 closely adjacent the bobbin 9. It is however stated that the greater the distance the yarn guide 11 is spaced from the bobbin 9, the more there is the possibility that the yarn end 3a will run laterally a greater distance, resulting in the above disadvantage. Therefore, in the prior art arrangement, the position of the yarn guide is a compromise between the aforementioned undesirability and possibility.

According to our invention, the yarn guide 11 is maintained in a position shown at 11a closely adjacent the bobbin 9 end when the yarn guide 11 is operative, i.e., at least during the formation of the transfer tail windings, the yarn guide 11 is moved to a position shown at 11b in FIG. 5 away from the location of the transfer tail windings 16 before the growing cheese 17 interferes with the yarn guide 11 maintained in the position 11a. In FIG. 4, a bobbin supporting the maximum diameter cheese is indicated by a reference numeral 9'.

Figure 6:
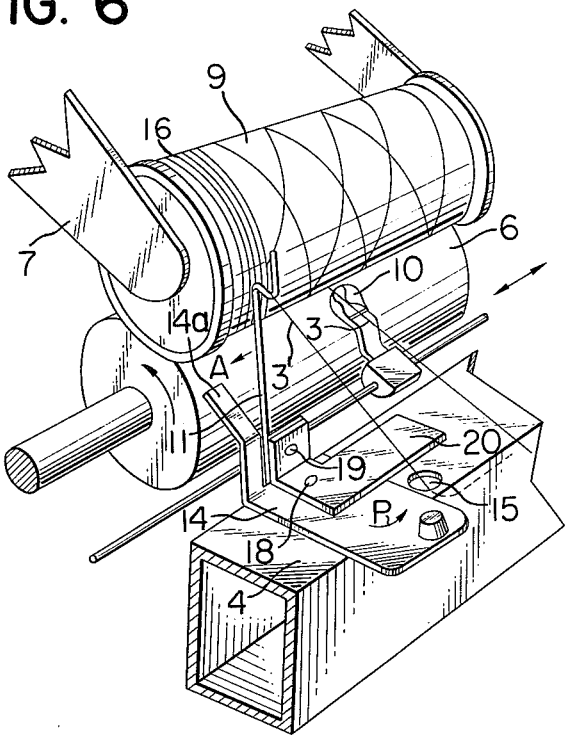
FIG. 6 is fragmental perspective view showing, partly in section, an improved arrangement constructed in accordance with the teachings of the present invention.

In a preferred embodiment of our invention shown in FIG. 6, the yarn guide 11 is pivotally connected at its lower portion to a generally L-shaped bracket 20 by a pin 19. The movable cutting member 14 is pivotally connected to the suction duct 4 by a pin 18 and has an extension 14a extending toward the bobbin 9. The extension 14a is contact with part of the yarn guide 11 when the cutting member 14 is rotated in the direction P. An edge of the bracket 20 facing the opening 15 is in the form of a stationary cutting edge. Thus, the bracket also serves as a stationary cutting member. The movable cutting member 14 acts to cut the yarn in cooperation with the stationary cutting member 20. The upper hooked portion of the yarn guide 11 serves to guide the pulled back yarn 3' toward the bobbin during the formation of the transfer tail windings 16. When the related components are in the states illustrated in FIG. 6, the yarn guide hooked portion occupies the shown position closely adjacent to the bobbin 9. That is, in the state when the movable cutting member 14 does not cover the opening 15, its extension 14a pushes against a portion of the yarn guide 11 so that the yarn guide hooked portion is maintained in the position as shown, which corresponds to the position 11a in FIGS. 4 and 5. Thus, the yarn 3' sucked by the suction duct 4 is allowed to be pulled back on the hooked portion of the yarn guide and rewound at the predetermined position on the bobbin end, providing good transfer tail windings. Thereafter, the movable cutting member 14 is manually moved in the direction P to cut the yarn 3 in cooperation with the stationary cutting member 20.

Figure 7:
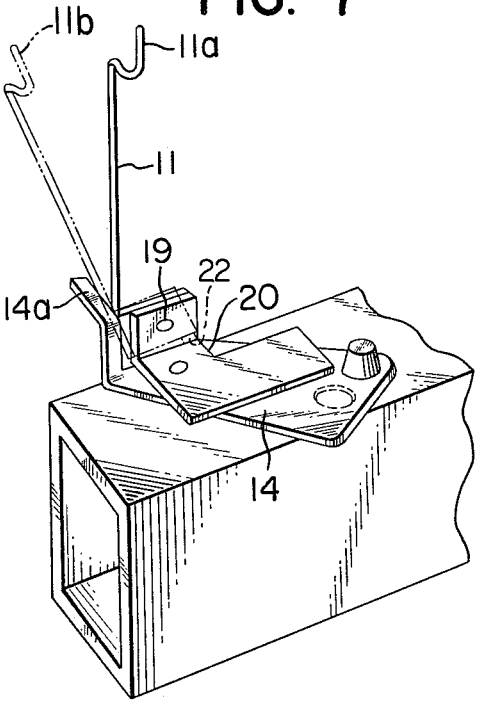
FIG. 7 is an enlarged view showing the essential parts of the arrangement of FIG. 6.

The yarn guide 11 is freely pivotable about the pin 19 and the center of gravity is to the right of pin 19 in FIGS. 6 and 7 when it is in the position 11a, such that the yarn guide 11 tends, due to its own weight to pivot in the clockwise direction in FIG. 6. The clockwise rotation of yarn guide 11 is limited by a stop 22 (FIG. 7), which may be attached to the bracket 20 or the suction duct 4 so that the yarn guide 11 is in the position 11a when it engages the stop 22. Therefore, even if the movable cutting member 14 is moved in the direction P and consequently its extension 14a is disengaged from the yarn guide 11, the latter will be maintained in the position 11a.

When the cheese 17 increases in diameter sufficient to cause the yarn guide 11 in the position 11a to be pushed leftwardly by the end face of the cheese 17, as shown schematically in FIG. 5, the direction of the pivotal moment of the yarn guide 11 due to movement of the position of its center of gravity to the left of pin 19 in FIGS. 6 and 7 is reversed and it tends to pivot in the counterclockwise direction. Therefore, the yarn guide 11 is automatically brought into the position 11b spaced from the bobbin 9. The yarn guide 11 in the position 11b is in engagement with the extension 14a of the movable cutting member 14 and therefore the latter also serves as a stop for the yarn guide 11.

The operative position 11a of the yarn guide 11 is so selected that when viewed in FIG. 5, its hooked portion guiding the pulled back yarn 3' is placed out of the range of yarn traverse, but within a range in which when the opposed ends of the cheese expand axially outwardly relative to the traverse width due to its characteristic as described above, the hooked portion is pushed by the expanded end of the cheese toward the position 11b; and that when, as viewed in FIG. 4, the hooked portion is moved out of, but closely adjacent the path of the bobbin 9 moving to a position shown at 9' due to the increase of the cheese diameter and is positioned adjacent the line connecting the opening 15 and the upper bobbin surface.

When the yarn guide 11 is moved in the direction A into the position 11b, the hooked portion thereof is laterally moved out of the range of the length of the bobbin 9 when viewed in FIG. 5 so that there is no interference with the movement of the bobbin and cheese.

Figure 8:
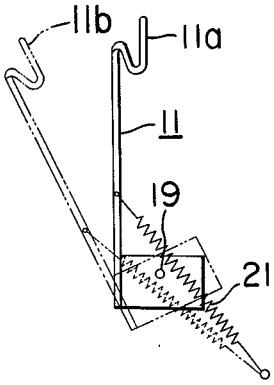
FIG. 8 is a view showing a resilient mechanism for biassing a yarn guide into either its operative and inoperative positions.

As shown in FIG. 8, the yarn guide 11 may be provided with a resilient member, such as a coil spring 21 to maintain the yarn guide 11 in the positions 11a and 11b. The spring 21 is connected at one end to the yarn guide 11 and at the other end to the stationary member 20 so that the direction of the moment applied to the yarn guide 11 is reversed at its dead center point.

In the preferred embodiment of FIG. 6, the yarn guide 11 moves to its operative position 11a along with the movable cutting member 14. This makes the operation of the yarn guide simple and avoids any possibility that the yarn guide is operated erroneously. However, the yarn guide 11 may be manually brought into the operative position 11*a*.

It is apparent from the foregoing that according to our invention the yarn guide 11 can be positioned closely adjacent the bobbin when it is in operation, so that there is no fear that the yarn end will be pinned under the yarn coming from the spinning chamber and successively wound on the bobbin. Furthermore, since the yarn guide can be moved to the operative position in cooperation with the movement of the cutter, no additional operation is necessitated by the yarn guide.

What we claim is:

1. A yarn winding mechanism comprising, in combination:

a bobbin holder for supporting a bobbin for rotation for winding a yarn fed from a supply thereon;

means disposed adjacent the bobbin holder for traversing the yarn fed from the supply in a predetermined width to form a cross-wound package on the bobbin;

suction duct means adjacent said traversing means and having a yarn suction opening for sucking the yarn fed from the supply through the yarn traversing means and to the bobbin into the yarn suction opening in preparation for a formation of a transfer tail winding on the bobbin before a normal yarn winding operation;

a yarn guide movably mounted between the position of the bobbin held by the bobbin holder and the yarn suction opening and movable between an operative guiding position, in which a portion thereof contacts the yarn for guiding it toward the bobbin for forming a transfer tail winding thereon, and in which position the yarn contact portion of the yarn guide is positioned close to the end of the predetermined yarn traverse width so that the yarn contact portion will be contacted by the end of the yarn package during winding due to the axially outward expansion of the package during an increase in the diameter of the package for moving the yarn guide out of the operative guiding position, and an inoperative position in which the yarn contact portion of the yarn guide is spaced from the position of the end of the fully wound yarn package and toward which the yarn guide is moved when contacted by the yarn package; and cutting means positioned between the yarn guide and the yarn suction opening for cutting the yarn therebetween after the formation of the transfer tail winding, the cutting means being movable between an operative cutting position and an inoperative position and having a portion thereof engaged with the yarn guide for forcing the yarn guide from the inoperative position into the operative guiding position thereof when the yarn cutting means is moved from the operative cutting position to the inoperative position.

2. The yarn winding mechanism as set forth in claim 1, wherein the cutting means comprises stationary cutting member disposed adjacent the yarn suction opening, and a movable cutting member movable between an operative cutting position and an inoperative position thereof, the movable and stationary cutting members being positioned so that the movable cutting member covers the yarn suction opening when it is in the operative cutting position, the movable cutting member having thereon said portion engaged with said yarn guide.

3. The yarn winding mechanism as set forth in claim 2, wherein the yarn guide is pivotally connected to the stationary cutting member and has a center of gravity for maintaining the yarn guide in the operative guiding position even when the engagement of said portion of the cutting means is ended.

4. The yarn winding mechanism as set forth in claim 2, wherein said portion of the movable cutting member is fixed in position when said movable cutting member is in the operative cutting position, whereby said portion serves as a stop for blocking the movement of the yarn guide when it reaches the inoperative position thereof.

5. The yarn winding mechanism as set forth in claim 1, further comprising resilient means connected between the yarn guide and a fixed portion of said mechanism for biasing the yarn guide toward the operative guiding position when it pivots past a dead center position toward the operative guiding position and toward the inoperative position when it pivots past a dead center position toward the inoperative position.

* * * * *